US005171131A

United States Patent [19]

Niemiec

[11] Patent Number: 5,171,131

[45] Date of Patent: Dec. 15, 1992

[54] POWER TRANSMISSION

[75] Inventor: Albin J. Niemiec, Sterling Heights, Mich.

[73] Assignee: Vickers, Incorporated, Troy, Mich.

[21] Appl. No.: 699,691

[22] Filed: May 14, 1991

[51] Int. Cl.[5] ..... F04D 49/08; F04C 27/00

[52] U.S. Cl. ..... 417/283; 417/310; 418/133

[58] Field of Search ..... 417/310, 283; 418/133, 418/132, 135

[56] References Cited

U.S. PATENT DOCUMENTS

| | | | |
|---|---|---|---|
| 3,695,791 | 10/1972 | Brundage | 418/133 X |
| 4,315,719 | 2/1982 | Sakamaki et al. | 418/133 |
| 4,420,290 | 12/1983 | Drutchas | 417/283 |
| 4,913,636 | 4/1990 | Niemiec | 418/133 X |

*Primary Examiner*—Leonard E. Smith
*Attorney, Agent, or Firm*—Barnes, Kisselle, Raisch, Choate, Whittemore & Hulbert

[57] ABSTRACT

A rotary fluid energy translating device of the sliding vane type useful as a pump or motor comprising a pressure contained vane unit assembly adapted to be submerged in a body of liquid. The pressure contained vane unit assembly comprises a pair of support plates, a cam ring interposed between the support plates, a rotor rotatably mounted in the cam ring and having a plurality of circumferentially extending vanes adapted to engage the contour of the cam ring and a flexible plate interposed between the cam ring and each of the support plates. Each support plate includes a hub portion spaced from its respective flexible plate. The assembly is clamped together with a clamping force in excess of the hydrostatic forces within the assembly. One of the support plates has an axial opening for insertion of a drive shaft into driving connection with the rotor and the other of the support plates has an axial liquid passage. Each support plate includes radial liquid passages defined by a groove at the juncture with its associated flexible plate. When used as a pump, the assembly is submerged in a liquid and the rotor is deiven to provide a pump, the radial passages provide inlet passages and the axial passage provides an outlet. The pressure contained vane unit assembly can also be used as a hydraulic motor by utilizing the axial passage as an inlet from a pressurized source such that the radial passages function as outlets for the fluid after its energy has been dissipated by rotating the rotor and vanes.

9 Claims, 9 Drawing Sheets

POWER TRANSMISSION

This invention relates to rotary fluid energy translating devices of the sliding vane types.

BACKGROUND AND SUMMARY OF THE INVENTION

In the manufacture and use of rotary fluid energy translating devices of the sliding vane types, it has been common to provide a vane pump housing in which a pair of end plates and a cam ring are positioned with the cam ring interposed between the end plates. A rotor is rotatably mounted on the cam ring and has a plurality of circumferentially extending vanes adapted to engage the contour of the cam ring. The housing has a liquid inlet and the interior of the housing is pressurized by the liquid.

Among the objectives of the present invention are to provide a rotary fluid energy translating devices of the sliding vane types which does not require a pressurized housing; which is relatively simple in construction; which can be utilized in a plurality of systems such as a pump, a fuel system, an electric motor driven in-line hydraulic pump, in a transmission system and as a liquid driven motor.

In accordance with the invention, a rotary fluid energy translating device of the sliding vane type useful as a pump or motor comprising a pressure contained vane unit assembly adapted to be submerged in a body of liquid. The pressure contained vane unit assembly comprises a pair of support plates, a cam ring interposed between the support plates, a rotor rotatably mounted in the cam ring and having a plurality of circumferentially extending vanes adapted to engage the contour of the cam ring and a flexible plate interposed between the cam ring and each of the support plates. Each support plate includes a hub portion spaced from its respective flexible plate The assembly is clamped together with a clamping force in excess of the hydrostatic forces within the assembly. One of the support plates has an axial opening for insertion of a drive shaft into driving connection with the rotor and the other of the support plates has an axial liquid passage. Each support plate includes radial liquid passages defined by a groove at the juncture with its associated flexible plate. When used as a pump, the assembly is submerged in a liquid and the rotor is driven to provide a pump, the radial passages provide inlet passages and the axial passage provides an outlet. The pressure contained vane unit assembly can also be used as a hydraulic motor by utilizing the axial passage as an inlet from a pressurized source such that the radial passages function as outlets for the fluid after its energy has been dissipated by rotating the rotor and vanes.

DESCRIPTION

Figure 1:
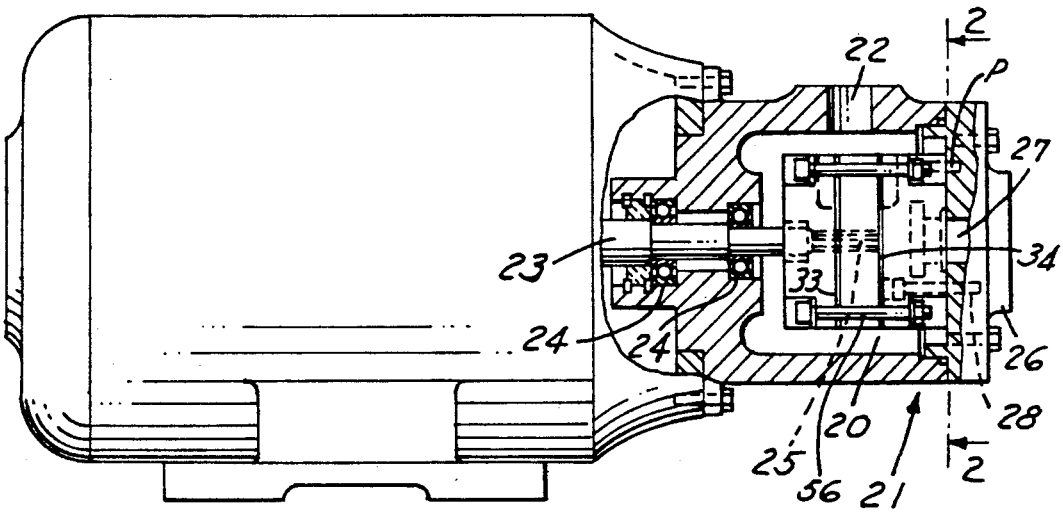
FIG. 1 is a part sectional view of a pressure contained vane unit pump assembly embodying the invention shown as used in a single hydraulic pump.

Referring to FIG. 1, in accordance with the invention, a pressure contained vane unit pump assembly 20 is utilized as a hydraulic pump by submerging the vane pump assembly 20 in an unpressurized container or housing 21 that has an inlet 22 for hydraulic fluid. Housing 21 rotatably supports a drive shaft 23 that is rotatably mounted by bearings 24 in the housing 21 and is driven from an external source. The shaft 23 includes a spline portion 25 for driving the vane unit pump assembly, as presently described. The pressure contained vane pump assembly 20 is mounted on a removable end plate 26 and the output from the vane pump assembly 20 is directed externally of the housing through an axial opening 27. Circumferentially spaced bolts 28 support the pressure contained vane unit pump assembly 20 on the end plate 26.

Figure 2:
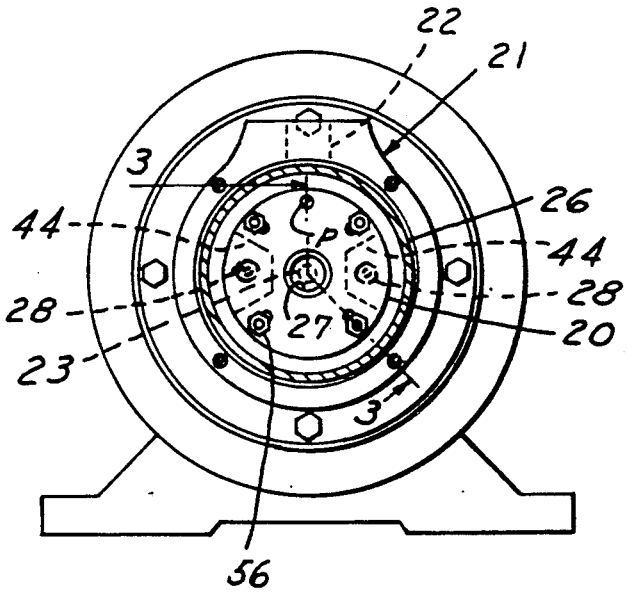
FIG. 2 is a sectional view taken along the line 2—2 in FIG. 1.
Figure 3:
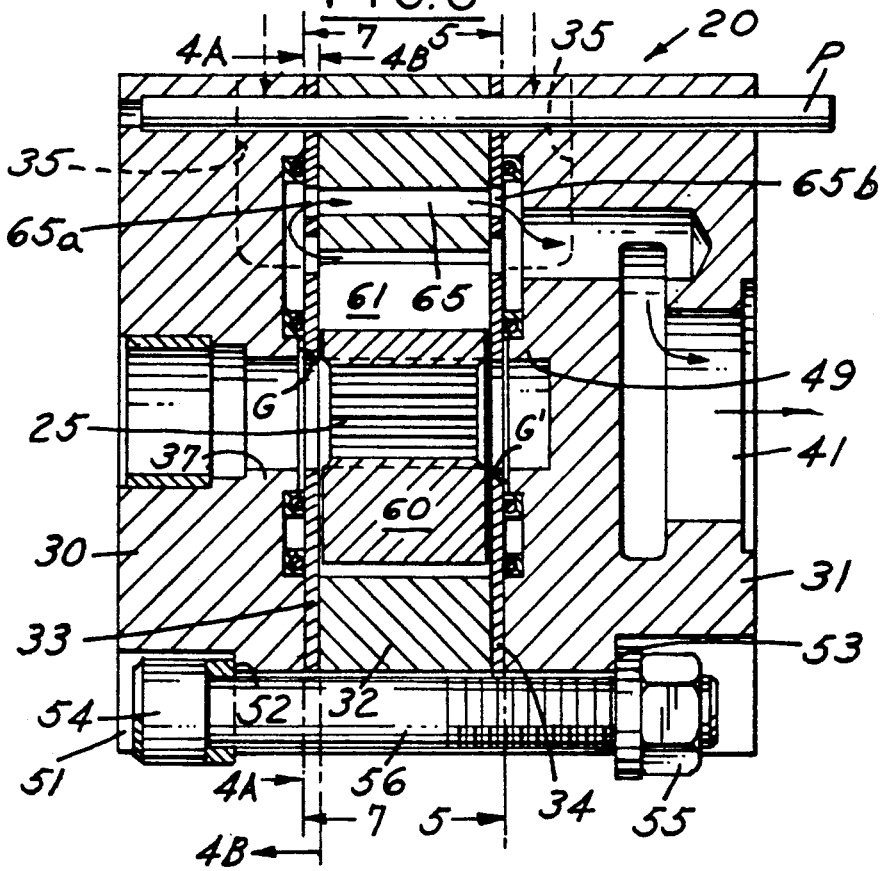
FIG. 3 is a sectional view of the flexible plate taken along the line 3—3 in FIG. 2.

Referring to FIGS. 2 and 3 which show the pressure contained vane pump assembly 20 on an enlarged scale, the pressure contained vane pump assembly 20 comprises support plates 30, 31, a cam ring 32 interposed between the end plates and flexible plates 33, 34 interposed between the end plate 30 and cam ring 32 and the end plate 31 and cam ring 32, respectively Each flexible plate 33, 34 is made of a metallic sheet of material, such as steel and bronze, with the steel forming a resilient flexible support and the bronze bearing material forming a bearing surface adjacent the rotor and vanes, in a manner well known in the art.

Figure 8:
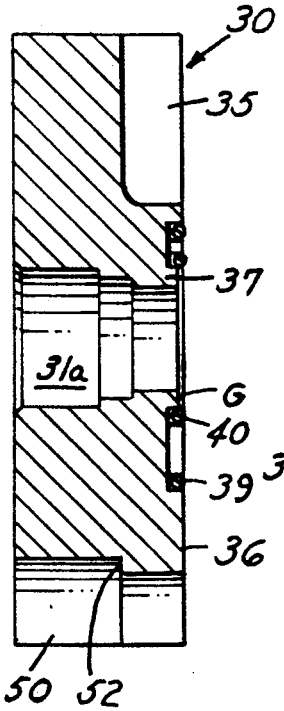
FIG. 8 is a sectional view taken along the line 8—8 in FIG. 7.
Figure 7:
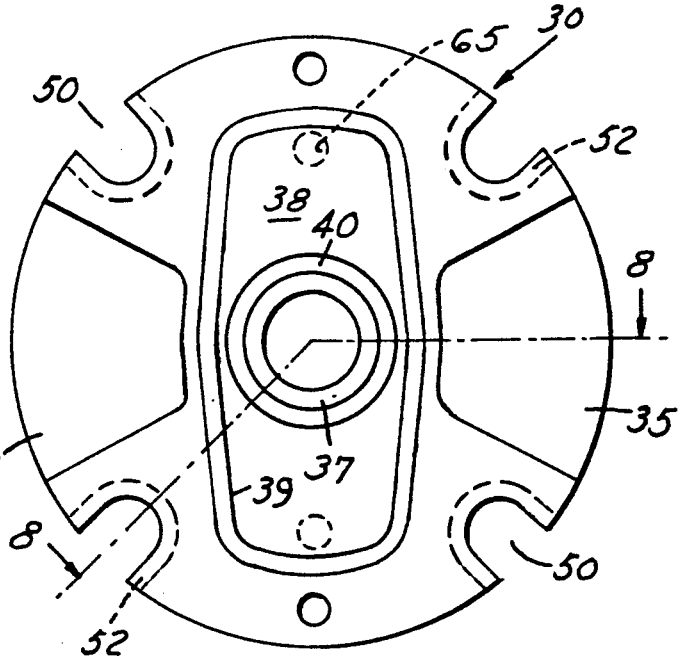
FIG. 7 is a sectional view taken along the line 7—7 in FIG. 3.

As shown in FIGS. 7 and 8, support plate 30 includes arcuate radial grooves 35 in the surface adjacent its associated flexible plate 33 to define inlets for hydraulic fluid and an axial opening 31*a* through which the drive shaft 23 extends. Support plate 30 includes a flat planar face 36 that engages the flexible plate 33. Support plate 30 further includes a hub 37 that extends toward the flexible plate 33 but is spaced therefrom to provide a gap G. A generally oval pocket 38 is provided in face 36. A seal 39 about the periphery of pocket 38 and a seal 40 about the periphery of the hub 37 engage the flexible plate 33 to isolate the space and define a hydrostatic pool.

Figure 5:
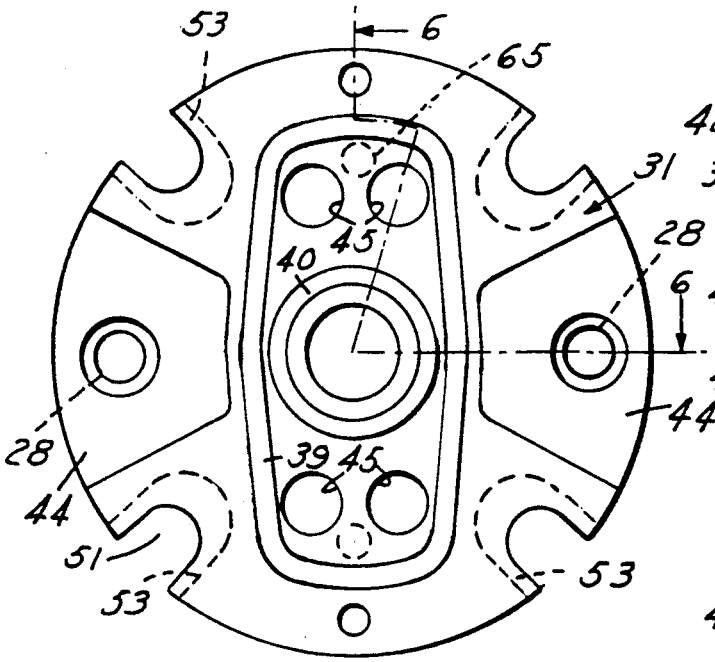
FIG. 5 is a sectional view taken along the line 5—5 in FIG. 3.
Figure 6:
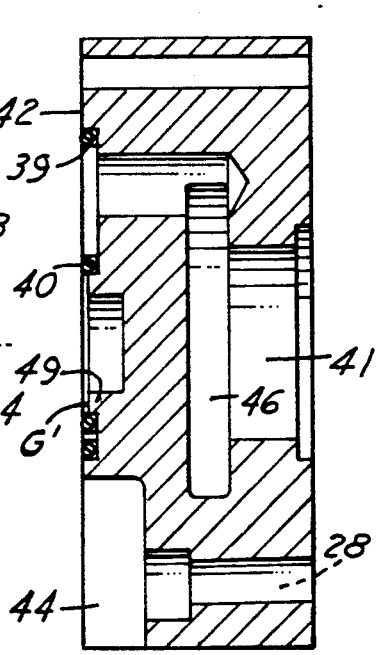
FIG. 6 is a sectional view of the other end plate taken along the line 6—6 in FIG. 5.

As shown in FIGS. 5 and 6, support plate 31 includes an axial passage 41 defining a discharge outlet extending axially for communicating with the outlet opening 27 in FIG. 1. Support plate 30 includes a flat planar face 42 and includes radial grooves 44 for passage of fluid from the housing surrounding the pump and axial outlet passages 45 that extend axially and communicate through a radial passage 46 with the outlet 41. A generally oval pocket 38 is provided in the face 42. The face 42 is provided with recesses for seals 39,40 in a manner similar to the plate 30. The plate 31 further includes a hub 49 that extends toward the flexible plate 34 but is spaced therefrom to form a gap G.

The plates 30, 31 are provided with circumferentially spaced slots 50, 51 that include a shoulder 52, 53 for receiving the head 54 and nut 55 of a bolt 56 to clamp the plates and rotor in assembled relation Washers 57 are provided between the bolt head 54 and the shoulder 50 and between the nut 55 and shoulder 53 to distribute the mechanical retention forces for retaining the clamping. The clamping forces must be greater than the hydrostatic forces within the pressure contained vane pump assembly and preferably several times greater. Locating pins P extend through the support plates 30, 31, flexible plats 33, 34 and cam ring 32 for engaging openings in the end plate 26 and orient the pressure contained vane assembly on the plate 26. (FIGS. 1 and 2).

A rotor 60 is rotatably mounted in the cam ring 32 and includes a plurality of circumferentially spaced vanes 61 that are provided in the slots in the rotor 60 and are adapted to engage the contour of the cam ring 32, in a manner well known in the art of making vane pumps such as shown for example in U.S. Pat. No. 3,567,350, incorporated herein by reference. In such vane pumps, rotation of the rotor causes the fluid to be drawn in between the vanes and be compressed as the rotor rotates carrying the pressurized fluid to the outlet. In another form, additional fluid or mechanical forces are provided for urging the vanes radially outwardly. Typical patents showing such a construction are U.S. Pat. Nos. 2,967,488, 4,008,002 and 4,913,636, incorporated herein by reference. Preferably, undervane chambers and intervane chambers are provided as shown in these patents and incorporated herein by reference.

The pressure contained vane pump assembly includes two opposed pumping chambers that are defined by the internal contour of the cam ring 32 each of which has fluid inlet zones and fluid outlet zones.

Figure 4A:
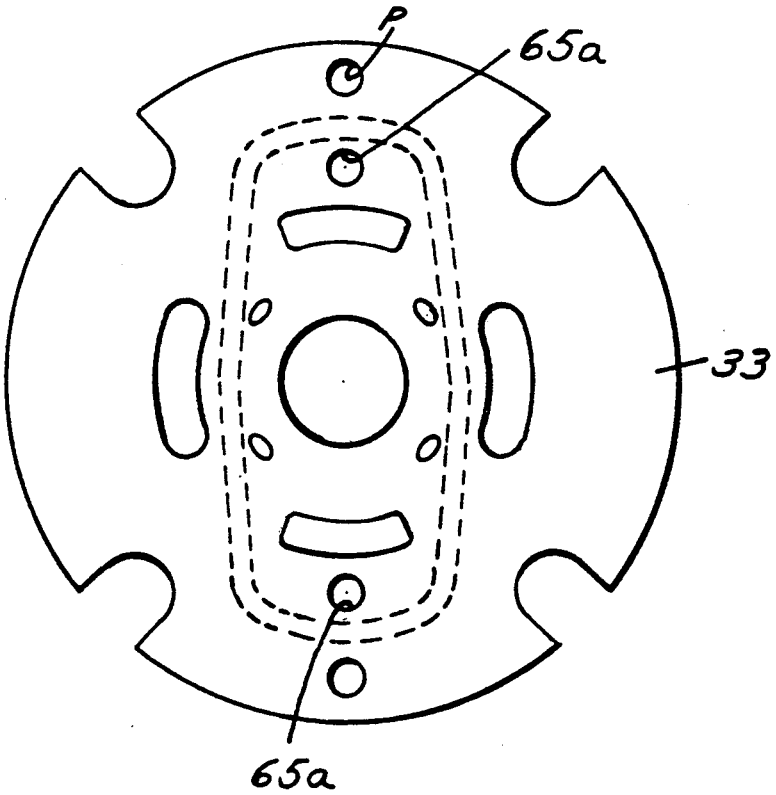
FIG. 4A is a sectional view of an end plate taken along the line 4A—4A in FIG. 3.
Figure 4B:
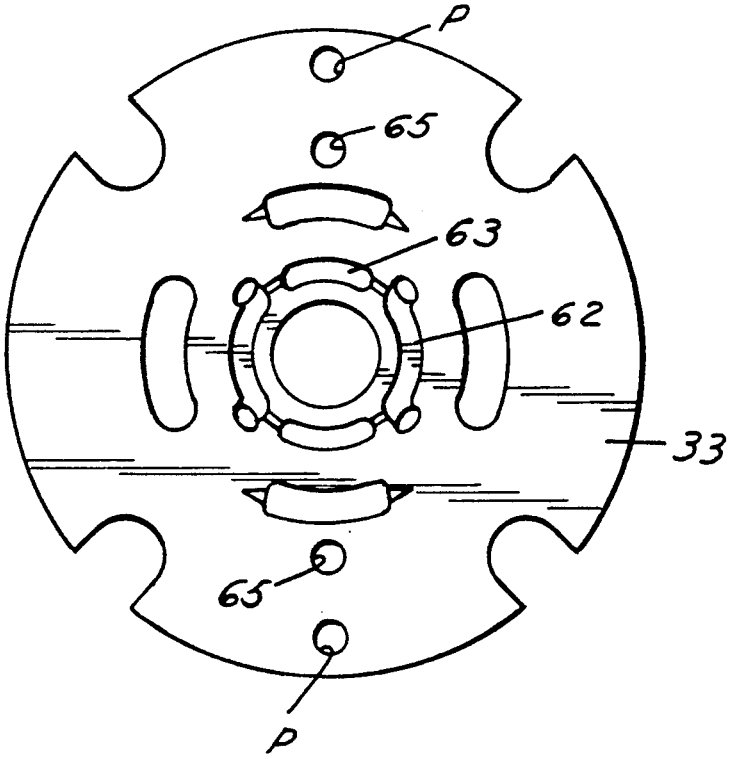
FIG. 4B is a sectional view of an end plate taken along the line 4B—4B in FIG. 3.

Referring to FIG. 4B, each of the flexible plates 33, 34 is provided with arcuate inlet passages 62 and arcuate outlet passages 63 to the undervane chambers associated with the rotor.

The cam ring 32 and flexible plates 33, 34 include aligned opening 65, 65*a*, 65*b* for permitting fluid to flow from the pressurized pool associated with support plate 30 to the pressurized pool associated with support plate 31 and then to discharge.

It can thus be seen that there has been provided a rotary fluid energy translating device of the sliding vane type as shown in FIG. 1, can be used as a pump submerged in a body of fluid that is not pressurized and which includes a pressure contained vane assembly.

An important feature of the pressure contained vane assembly comprises the provision of an axial clearance or gap G, G'. This can best be understood by reference to the analysis of temperature gradients in the operation.

A temperature gradient exists between the rotating vane group and the valve surface of each flexible side plates 33, 34. In the outer region, the large displaced volume maintains a relatively constant surface temperature. At the inner region, the close axial clearance prevents the circulation of fluid. Also, any high pressure leakage is throttled which also contributes to the temperature build-up. The shearing of the fluid film will contribute to the temperature build-up.

Figure 14:
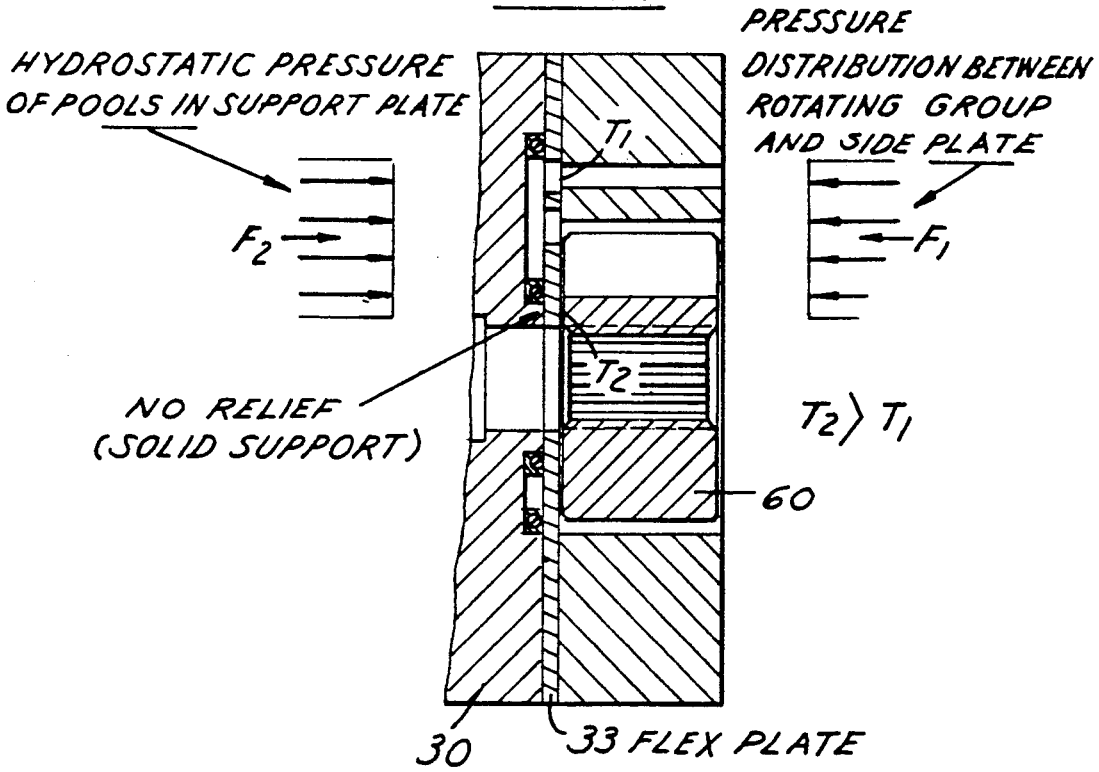
FIG. 14 is a diagrammatic view of a pressure contained vane unit pump without a feature of the invention.

The accumulation of heat inputs and the restricted ability to dissipate the temperature will create a temperature gradient $T_2 > T$ on the valve surface and the adjacent surface of the rotor (FIG. 14). The gradient will cause the valve/bearing surface of the flexible plate to distort inward and the rotor dimensions to grow. The support plate behind the flexible plate will respond accordingly. The net result will reduce the axial clearances such that rotating group will make contact with the flexible plate and seize.

The design of the hydrostatic pressure pools in the support plates are such as to axially balance or slightly exceed the pressure distribution between the valve surface and the rotating group. When a flexible plate distorts inward, the axial clearances become restricted and the magnitude of the pressure distribution increases because the leakage has been reduced.

With no axial inner relief on the support plate, the flexible plate cannot be deflected away and contact with the rotating group will result. (FIG. 14).

Figure 15:
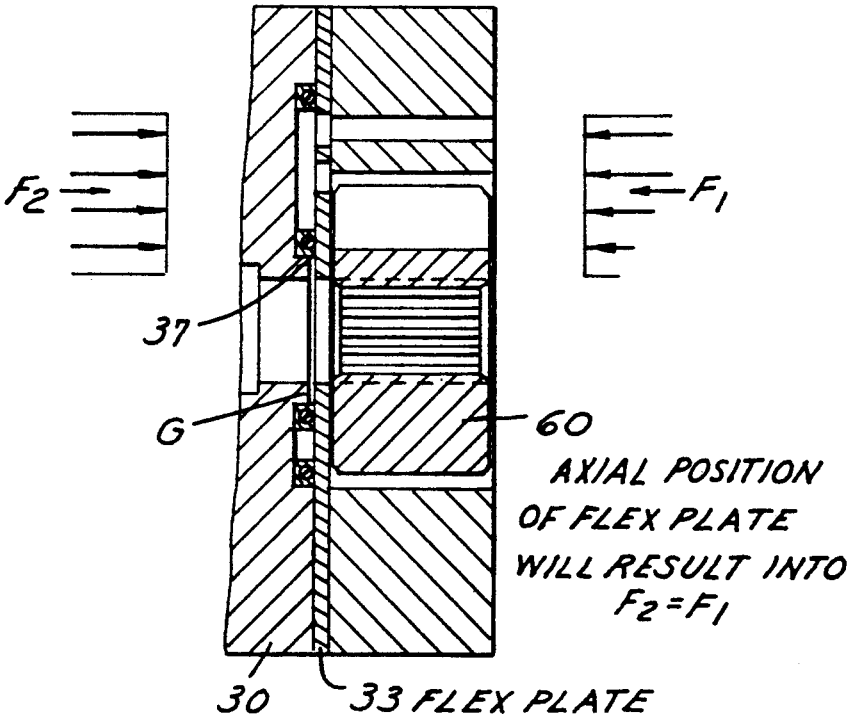
FIG. 15 is a diagrammatic view of a pressure contained vane unit pump assembly with an important feature of the assembly.

With the axial relief or gap G, G', the higher magnitude of the pressure distribution will deflect the flexible plate away from the rotating group. The axial position of the flexible plate will seek a force equilibrium where $F_1 = F_2$. (FIG. 15). The valve surface of the flexible side plate features a bearing material surface to allow for self healing caused by momentary rubbing contacts and to promote heat dissipation.

The described design corrects the problem associated with fixed clearance pump designs and in applications requiring a wide degree of operating temperatures.

Thus, the hydrostatic balancing of the flexible side plates provides for better control of the axial clearances of the rotating pump group and improves volumetric performance.

Figure 9:
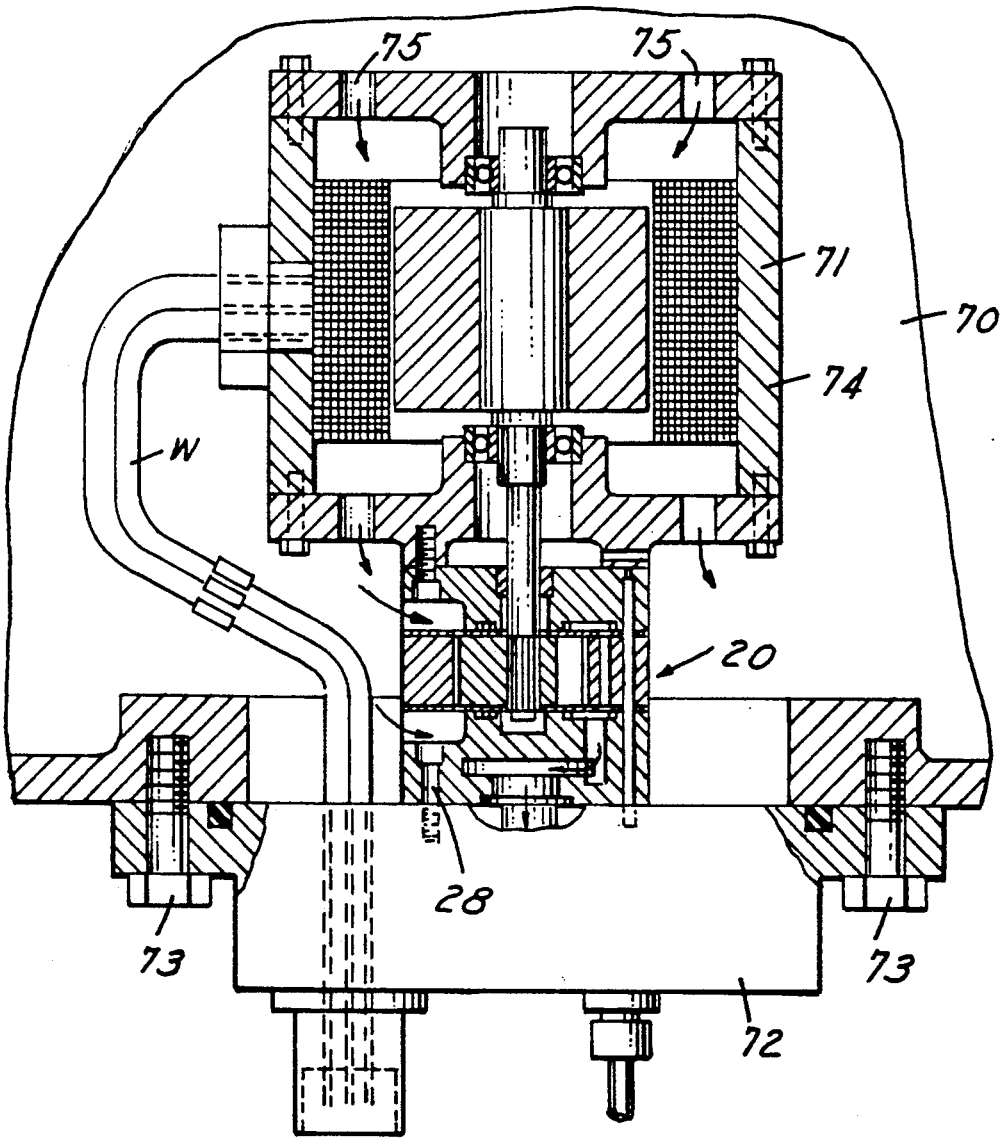
FIG. 9 is a part sectional view showing the pressure contained vane unit pump assembly as applied to a fuel system.

Referring to FIG. 9, the pressure contained vane unit pump assembly is shown as positioned in a fuel tank 70 such as an aircraft fuel tank. Specifically, the assembly of an electric motor 71 and pressure contained vane unit pump assembly 20 are mounted on a removable end plate 72 held in position by bolts 73 such that the entire assembly can be removed. The end plate supports a valve block of conventional construction containing flow distribution and pressure controls. As shown, the wiring W for the electric motor 71 extends to the end plate 71 that houses the valve block for the fuel. The housing 74 of the electric motor 71 includes openings 75 to permit the fuel to circulate through the electric motor 71 and cool the motor 71.

Figure 10:
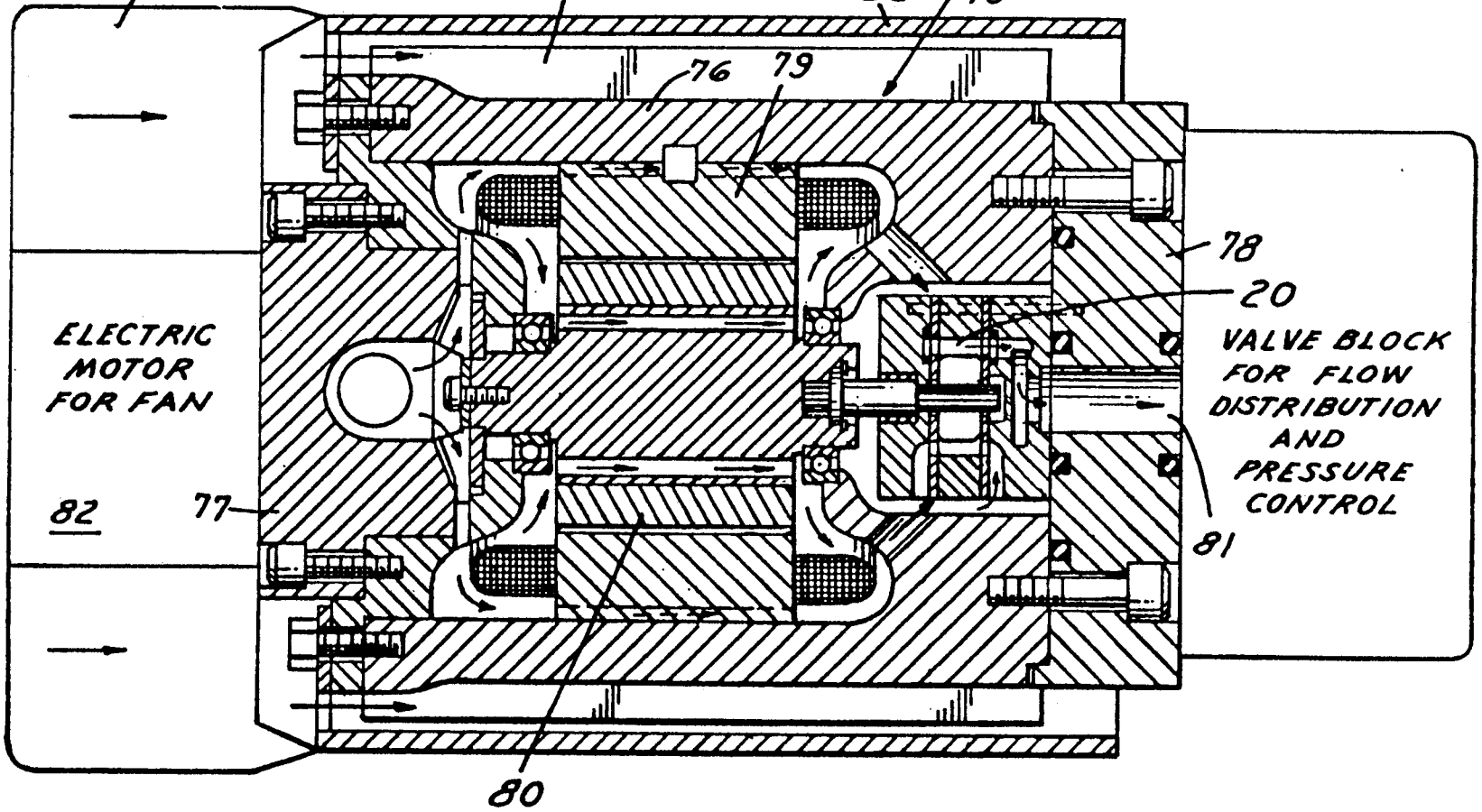
FIG. 10 is a longitudinal sectional view of the pressure contained vane unit pump assembly integrated with an electric motor.

In the form shown in FIG. 10, the pressure contained vane unit pump assembly 20 is shown internally mounted on an end plate of an electric motor housing as disclosed but not claimed in U.S. application Ser. No. 07/687,173 filed Apr. 18, 1991, Docket No. V-4211, having a common assignee with the present application, incorporated herein by reference. The electric motor 75 includes a housing 76 and end plates 77, 78, a stator 79 and a rotor 80 rotatably mounted in the end plates 77, 8 by bearings. End plate 78 has an axial outlet 81 for liquid to a valve block. An electric motor 82 causes a fan 83 to direct air over longitudinal ribs 84 on the housing 76 to facilitate cooling. A shroud 85 surrounds the housing 76 to contain and direct the air flow.

Figure 16:
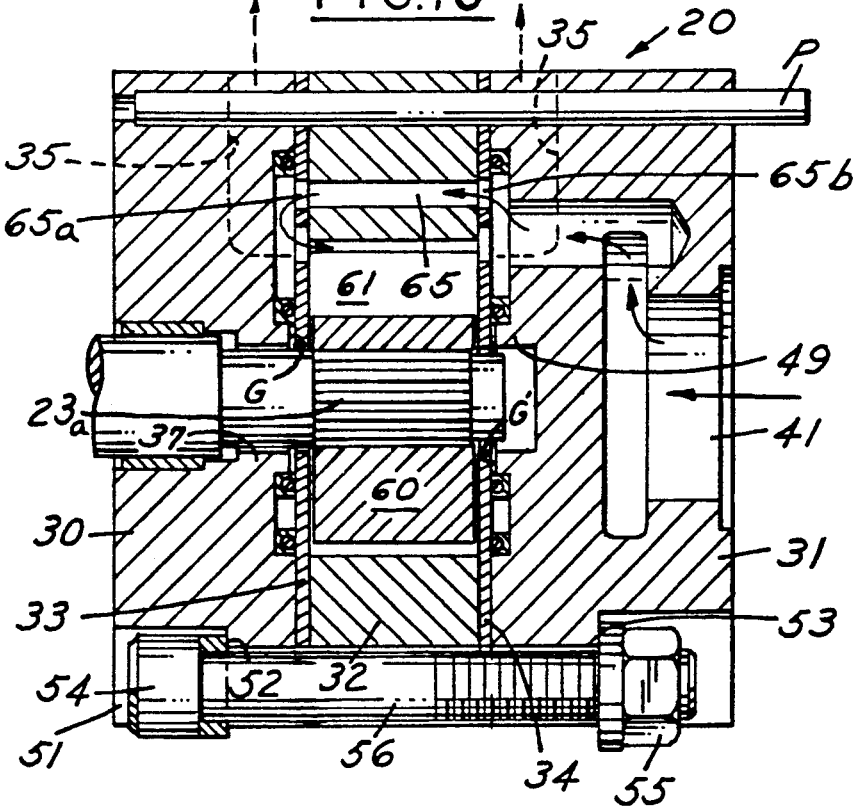
FIG. 16 is a sectional view showing the pressure contained vane unit pump assembly used as a motor.

The pressure contained vane unit pump assembly 20 as shown in FIG. 16 can also be used as a hydraulic motor by utilizing the axial passage as an inlet from a pressurized source such that the radial passages function as outlets for the fluid after its energy has been dissipated by rotating the rotor and vanes.

Figure 11:
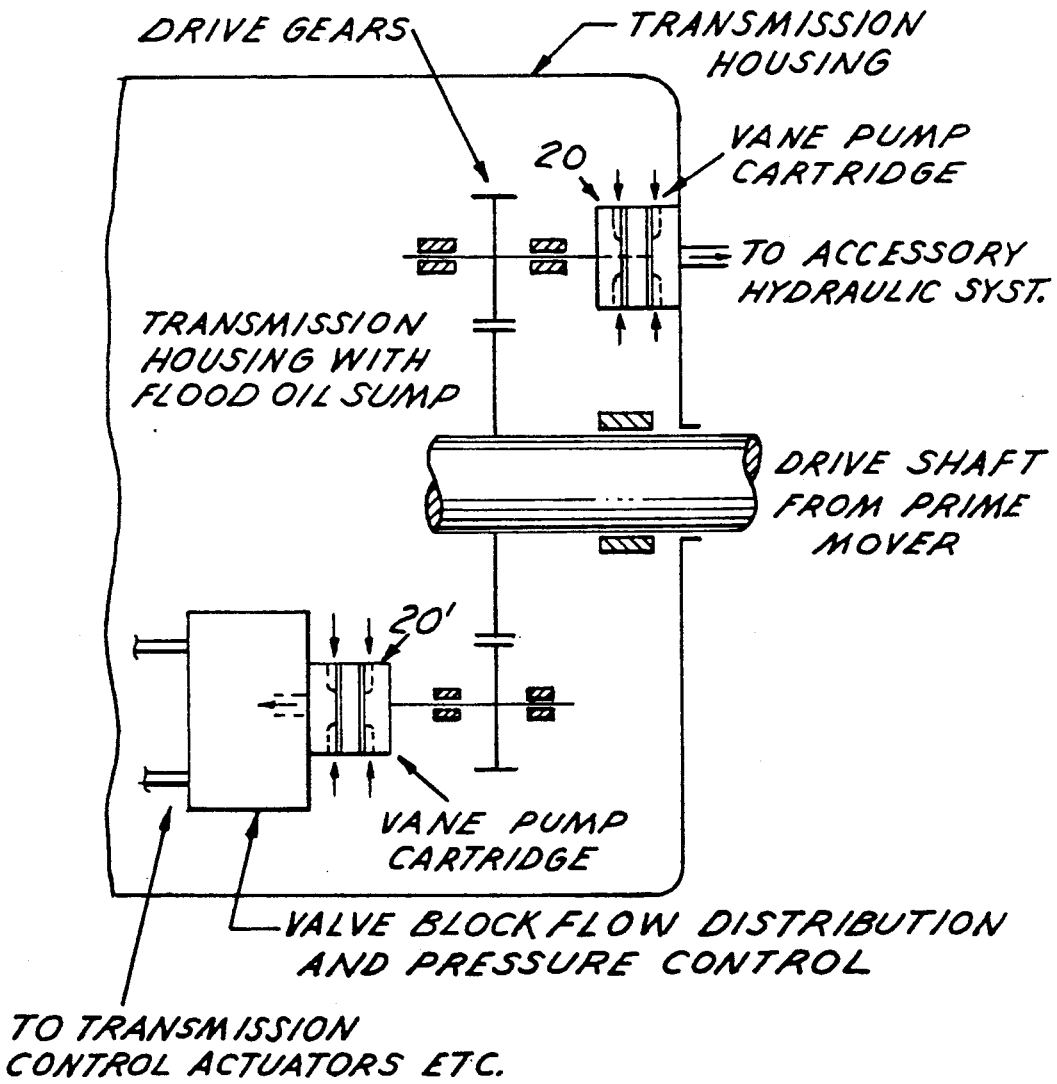
FIG. 11 is a diagrammatic view showing the use of the pressure contained vane unit pump assembly in a transmission system.

In FIG. 11, the pressure contained vane unit pump is shown as mounted in an automotive transmission such as the internal wall of the transmission and is driven mechanically by gearing in the transmission. The output of the pressure contained vane unit assembly 20 is utilized for hydraulic accessories such as power steering, suspension systems or other power operated devices. As shown, a second pressure contained vane pump assembly 20 can be provided, for controlling actuators in the transmission.

Figure 12:
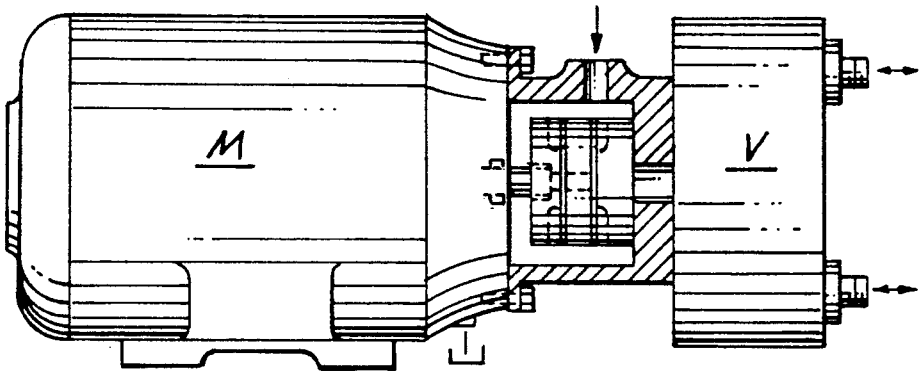
FIG. 12 is a part sectional view showing the pressure contained vane unit pump assembly utilized with an externally driven electric motor pump system.
Figure 13:
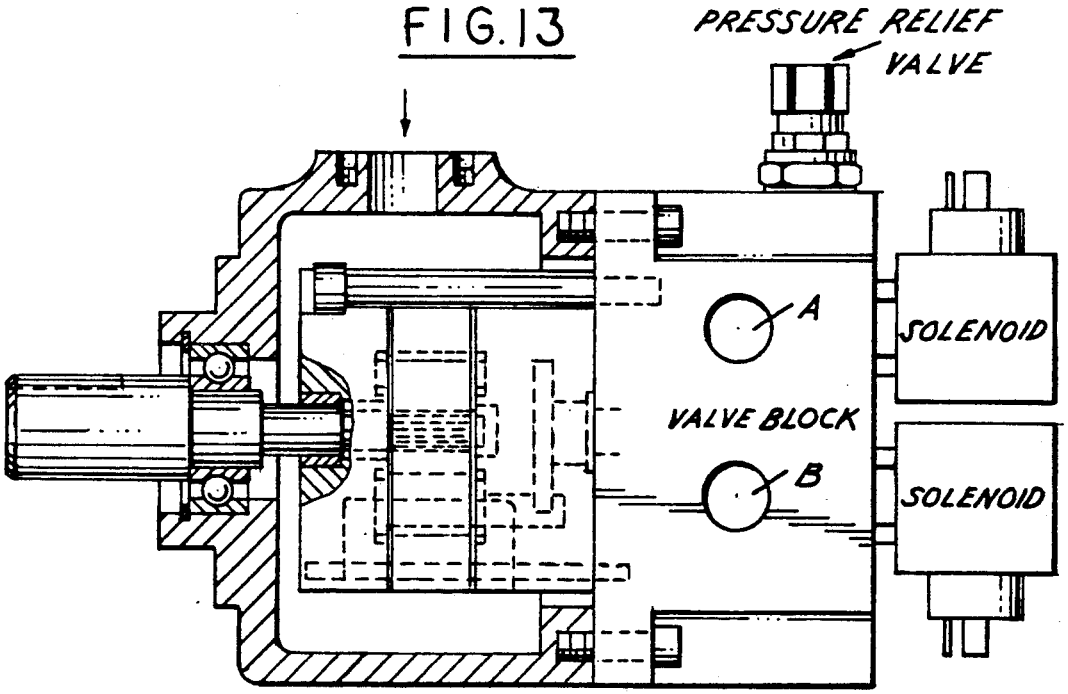
FIG. 13 is a part sectional view of an integrated pressure contained vane unit pump and valve block assembly.

In the form shown in FIG. 12, the pressure contained vane unit pump assembly 20 is mounted on a conventional electric motor M and valve block V is associated with the outlet of the vane pump assembly 20 for controlling flow distribution and pressure control.

It can thus be seen that there has been provided a novel vane pump assembly which does not require a pressurized housing; which is relatively simple in construction; which can be utilized in a plurality of systems such as a pump, a fuel system, an electric motor driven in-line hydraulic pump, and in a transmission system.

I claim:

1. A pressure energy translating device of the sliding vane type comprising a pressure contained vane unit cartridge assembly, said pressure contained unit vane cartridge assembly comprising a pair of support plates, a cam ring interposed between said support plates, a flexible plate interposed between each support plate and said cam ring, a rotor rotatably mounted in said cam ring and having a plurality of circumferentially extending vanes adapted to engage the contour of the cam ring, means for clamping said assembly to hold said support plates and cam ring in assembly relation to form a pressurized vane assembly by applying axial clamping forces on said support plates, said means comprising the sole means for holding said pump vane cartridge assembly in assembled relation, the clamping force being greater than the internal hydrostatic forces in said assembly, one of said support plates having an axial opening for insertion of a drive shaft into driving connection with said rotor, each said support plate including a transverse wall and axially extending walls forming a pocket in a face facing the flexible plate and a hub in said pocket axially extending away from said transverse wall, the other of said support plates having an axial fluid passage therein, each said end plate further including at least one radial fluid passage, each said hub being in axial spaced relation with the associated flexible plate to form a gap between said hub and flexible plate sufficient to maintain an axial clearance at operation conditions wherein the temperature of the rotor and the flexible plate might cause distortion thereof.

2. The pressure energy translating device set forth in claim 1 including an unpressurized housing having a wall with a discharge -outlet, means for mounting said pressure contained vane assembly on said wall with the outlet of the assembly aligned with the discharge opening in said wall, said housing having an opening, an electric motor, means for mounting said housing on said electric motor such that a drive shaft thereof engages the rotor the vane pump cartridge assembly.

3. The pressure energy translating device set forth in claim 1 including means for driving said rotor such that the pressure contained vane unit assembly functions as a motor wherein said axial fluid passage is an inlet and said radial passages are outlets.

4. The pressure energy translating device set forth in claim 1 wherein said pressure contained vane unit assembly is submerged in a body of liquid and means are provided for rotating said rotor such that the assembly functions as a pump body of liquid, said housing having an inlet for liquid, said housing having a wall with a discharge opening, and means for mounting said cartridge assembly on said wall with the outlet of said cartridge assembly communicating with the discharge outlet of the housing.

5. The pressure energy translating device set forth in claim 4 wherein said body of liquid is a housing, said housing including a drive shaft rotatably mounted therein and engaging the rotor of the pressure contained vane unit assembly.

6. The pressure energy translating device set forth in claim 2 wherein including an electric motor having said housing, said electric motor having a stator and a rotor submerged in said housing, said housing having a wall, means for mounting said pressure contained vane unit pump assembly on said wall, said wall having a discharge outlet communicating with the outlet of the pressure contained vane unit pump assembly, said motor housing having a drive shaft rotatably mounted in another wall thereof, said drive shaft engages the rotor.

7. The pressure energy translating device set forth in claim 2 including a transmission housing containing transmission gearing, said housing having said body of oil comprising the fluid therein, said transmission including drive gears, a valve block mounted in said transmission housing and being submerged in said oil, said pressure contained vane pump cartridge assembly being mounted on said valve block and means providing a driving connection between the gearing of the transmission and the rotor of the vane pump cartridge assembly.

8. The pressure energy translating device set forth in claim 4 wherein said liquid comprises liquid fuel in a tank, said tank having a wall, said pressure contained vane unit assembly being mounted in said wall, an electric motor being mounted on said pressure contained vane unit assembly and having a drive shaft engaging the rotor of the pressure contained vane unit pump assembly, said wall of the fuel tank having a discharge outlet communicating with the outlet of said pressure contained vane unit pump assembly.

9. The pressure energy translating device set forth in claim 8 including a valve block exteriorly of said fuel tank, said valve block closing the opening in said fuel tank, said pressure contained vane unit assembly and motor being mounted on said valve block such that the valve block, valve cartridge assembly and electric motor comprise a removable sub-assembly.

* * * * *